United States Patent [19]
Liou

[11] 4,433,442
[45] Feb. 28, 1984

[54] TOILET SEAT AND COVER OPERATING DEVICE

[76] Inventor: Shu L. Liou, 2 Fl., No. 33, La. 52, Szu Wei Rd., Taipei, Taiwan

[21] Appl. No.: 367,253

[22] Filed: Apr. 12, 1982

Related U.S. Application Data

[63] Continuation-in-part of Ser. No. 192,182, Sep. 30, 1980, abandoned.

[51] Int. Cl.³ ..... A47K 13/10
[52] U.S. Cl. ..... 4/251
[58] Field of Search ..... 4/251

[56] References Cited

U.S. PATENT DOCUMENTS

| | | | |
|---|---|---|---|
| 481,498 | 8/1892 | Kremelberg | 4/251 X |
| 1,291,125 | 1/1919 | Pope | 4/251 |
| 1,821,027 | 9/1931 | Oya | 4/251 |
| 2,605,478 | 8/1952 | Lassiter | 4/251 |
| 3,766,571 | 10/1973 | Elder et al. | 4/394 X |
| 3,781,924 | 1/1974 | Davis | 4/251 |
| 4,291,422 | 9/1981 | Shoemaker | 4/251 |

FOREIGN PATENT DOCUMENTS

| | | | |
|---|---|---|---|
| 2621 | 10/1899 | Denmark | 4/251 |
| 27643 | 10/1909 | Sweden | 4/251 |
| 297187 | 9/1928 | United Kingdom | 4/251 |

*Primary Examiner*—Charles E. Phillips
*Attorney, Agent, or Firm*—Tak Ki Sung

[57] ABSTRACT

A device for operating the seat and cover of a flushing toilet having a flushing tank, comprising a pair of floats installed in the flushing tank and capable of ascending and descending in the flushing tank, the floats being operatively connected with the seat and cover so that the seat and cover are raised to an upright position when the floats ascend, and lowered when the floats descend. The device further comprises holding levers adapted to hold the floats submerged in the water in the flushing tank. The holding levers are operable by hand to release the floats thus allowing the floats to buoy up or ascend and consequently raise the seat and cover, which are then lowered when the water in the flushing tank is drained to flush the toilet and the floats descend with the descending water level.

13 Claims, 18 Drawing Figures

TOILET SEAT AND COVER OPERATING DEVICE

BACKGROUND OF THE INVENTION

This application is a continuation-in-part application of U.S. Ser. No. 192,182 filed on Sept. 30, 1980 now abandoned.

The present invention relates to a toilet seat and cover operating device. In particular, the present invention relates to a device for operating the seat and cover of a flushing toilet having a flushing tank, comprising a pair of floats installed in the flushing tank and capable of ascending and descending in the flushing tank, the floats being operatively connected with the seat and cover so that the seat and cover are raised to an upright position when the floats ascend, and lowered when the floats descend. The device further comprises holding levers adapted to hold the floats submerged in the water in the flushing tank. The holding levers are operable by hand to release the floats thus allowing the floats to buoy up or ascend and consequently raise the seat and cover, which are then lowered when the water in the flushing tank is drained to flush the toilet and the floats descend with the descending water level.

Conventional flushing toilets are provided with a seat and a cover and a flushing tank. The seat and the cover are hinged to the tiolet bowl so they can be raised upright and lowered as desired. The raising and lowering of the seat or cover are usually performed by hand. A known device for raising and lowering the toilet seat and cover comprises an electric motor which requires electric power.

The applicant is aware of the devices as disclosed in

U.S. Pat. No. 3,766,571
U.S. Pat. No. 1,821,027
U.S. Pat. No. 481,498
U.S. Pat. No. 1,291,125
U.S. Pat. No. 3,781,924
U.S. Pat. No. 4,291,422
U.S. Pat. No. 2,605,478
U.K. Pat. No. 297,187
Denmark Pat. No. 2621
Swedish Pat. No. 27643

However, the devices disclosed in these patents employ either a piston-and-cylinder mechanism or a manually operated mechanism without utilizing the gravity and buoyancy of a float provided in the flushing tank.

According to the present invention there is provided a toilet seat/cover operating device comprising: (a) a float member installed in the flushing tank for a toilet bowl, the flushing tank provided with a casing, the float member being capable of moving up and down in the flushing tank; (b) connecting means for operatively connecting the float member to the seat/cover of the toilet bowl so as to raise and lower the toilet seat/cover in association with the upward and downward movements of the float member; (c) holding means for latching the float member when the float member moves down to a lowermost position and holding it submerged when the flushing tank is filled with water, (d) releasing means for causing the holding means to release the float member from being latched to enable the float member to buoy up through the water in the flushing tank.

The present invention thus provides a novel device that operates the toilet seat and cover in association with the ascending and descending movements of floats installed in the flushing tank of a toilet without the need of hand operation or electric power means.

BRIEF DESCRIPTION OF THE DRAWINGS

The present invention will be further illustrated by way of the accompanying drawings, in which.

DETAILED DESCRIPTION OF THE INVENTION

Figure 1:
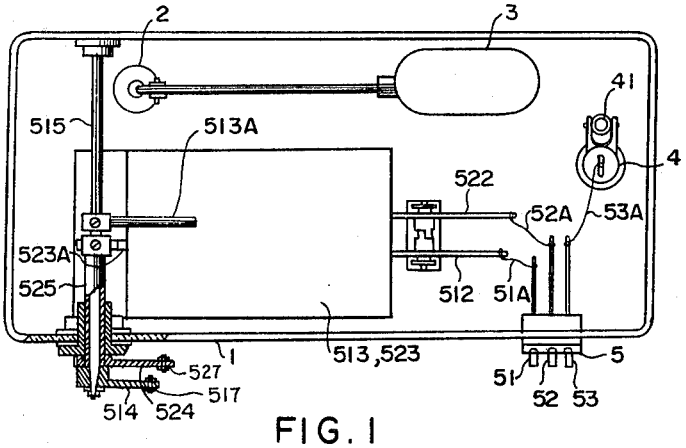
FIG. 1 is a top view of a flushing tank having a first embodiment of the toilet seat and cover operating device of this invention, with the tank cover removed, and partially in section.
Figure 2:
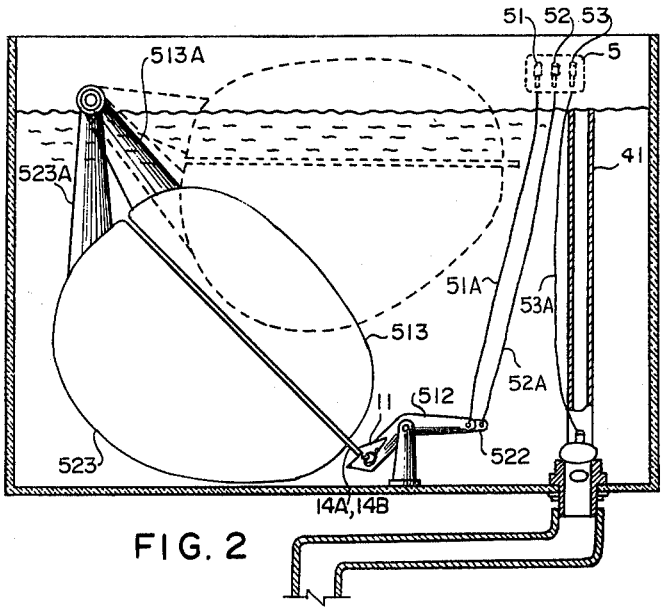
FIG. 2 is a vertical, longitudinal, cross sectional view of the flushing tank shown in FIG. 1.
Figure 3:
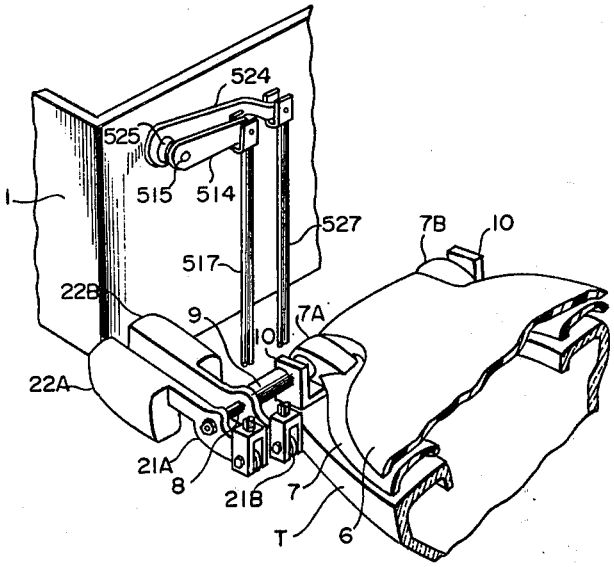
FIG. 3 is a fragmental, perspective view of the rear portion of a toilet seat and cover having the device of this invention, showing the arrangement of connecting rods.

As shown in FIGS. 1, 2 and 3, the first embodiment of this invention comprises a pair of floats 513, 523 having extension rods 513A, 532A, shafts 515, 525, levers 514, 524 and connecting rods 517, 527. Shaft 525 is hollow and shaft 515 is rotatably inserted therein with both ends extending beyond both ends of shaft 525. Shaft 525 is rotatably installed on the flushing tank casing 1 in such a manner that one end protrudes outwardly and the other end inwardly through the wall of the casing 1. The ends of each extension rod 513A, 523A are fixedly connected to the inner portion of shafts 515, 525 respectively. The outer ends of shafts 515, 525 are respectively provided with levers 514, 524 fixedly mounted thereon, which are respectively operatively connected to the cover and seat with connecting rods 517 and 527, which will be described in detail later. Floats 513, 523 are thus capable of moving up and down, or ascending and descending around the axis of shafts 515, 525, thus causing shafts 515, 525 to rotate accordingly.

In FIG. 1, 1 is a flushing tank casing; 2, a water inlet valve; 3, a float for controlling the water inlet valve; 4, a flushing valve, 41, an overflow pipe; all of these are of conventional construction.

Figure 5:
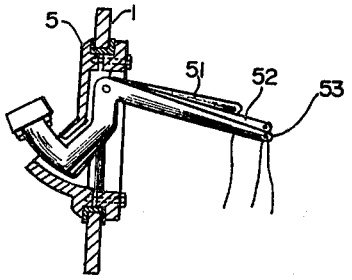
FIG. 5 is schematic drawing showing the arrangement of the release levers and the flushing lever used in the first embodiment.

In a suitable place on casing 1 a bracket 5 is provided as shown in FIGS. 1, 2 and 5; and two release levers 51, 52, and a flushing lever 53 are pivotally mounted thereon, in which levers 51, 52 are operatively connected to holding levers 512, 522 with a chain or a flexible cord 51A, 52A and the flushing lever 53 to the flushing valve 4 with a chain or flexible cord 53A.

Referring to FIG. 3, toilet cover 6 is fixedly mounted on rod 8 which is pivotally supported by brackets 10 on the rear, upper portion of the toilet bowl T. The lower end of connecting rod 517 is operatively connected to one end of said rod 8 with an arm 21A provided with a counter weight 22A. Toilet seat 7 is provided with two yokes 7A and 7B; yoke 7A is fixedly mounted on sleeve 9 which is passed over rod 8 and is rotatably supported by bracket 10, and yoke 7B is pivotally mounted on rod 8. The lower end of connecting rod 527 is operatively connected to said sleeve 9 with an arm 21B provided with a counter weight 22B.

Figure 4:
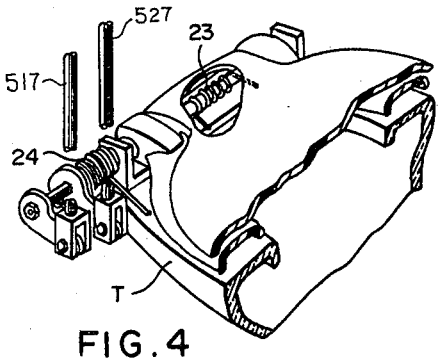
FIG. 4 is a fragmental, perspective view of the rear portion of a toilet seat and cover having the device of this invention, showing a modified arrangement of connecting rods.

Counter weights 22A, 22B may be eliminated if cover 6 and seat 7 are not very heavy, or are provided with resilient urging means such as springs 23 and 24 to offset part of the weight of cover 6 and seat 7 as shown in FIG. 4.

Figure 7:
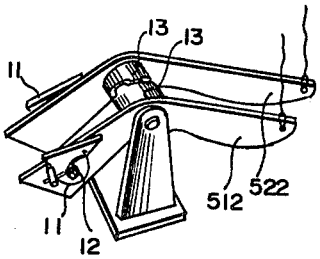
FIG. 7 is a perspective view of the holding levers.

Holding levers 512, 522 are provided in the lower part of the flushing tank and are pivotally mounted to the tank structure. Each of holding levers 512, 522 as shown in FIG. 7, is provided with a latch 11 urged by a spring 12, said latch 11 being adapted to latch float 513 523 when float 513 or 523 descends to its lower most position. Holding levers 512 and 522 are so designed that the end which is connected to release lever 51 or 52 by a chain or a flexible cord is made heavier than the other end which is adapted to hold float 513 or 523 when float 513 or 523 descends to the lower-most position, so that latch 11 is caused to latch on tongue 14A or 14B of float 513 or 523 to be described later, in association of the counter clockwise rotation of lever 512 or 522 when float 513 or 523 descends and hits the end of holding lever 512 of 522. Said holing levers 512, 522 are mutually coupled by a pair of couplings 13 in such a manner that when holding lever 522 is caused to rotate counter-clockwise holding lever 512 is caused to rotate with holding lever 522; but when holding lever 512 is caused to rotate counter clockwise, holding lever 512 is not caused to rotate therewith.

Latch 11, being urged by a spring 12, is capable of rotating clockwise with respect to holding lever 512 or 522 to release float 513 or 523, when the force so acting on latch 11 by tongue 14A or 14B exceeds the force generated by the buoyancy of float 513 or 523. This prevents latches 11 and holding levers 512, 522 from being damaged in case the toilet seat or cover is raised by hand without operating the device of this invention.

Figure 6:
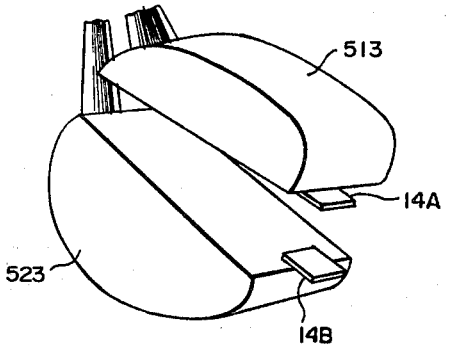
FIG. 6 is a schematic, perspective view of the floats used in this invention.

Floats 513, 523 are provided with a pair of tongues 14A, 14B which are offset as shown in FIG. 6, so that when they descend to the lower-most position, tongues 14B, 14A come into contact with holding levers 512 or 522 respectively and are latched by the latches 11, thus holding the floats 513, 523 in the lower-most position.

Float 513 is preferrably arranged on top of float 523 as shown in FIGS. 2 and 6. This arrangement restricts the relative movements of the two floats 513, 523 in such a manner that float 513 descends with or after float 523, and float 523 ascends with or after float 513, to follow the limitation that toilet seat 7 has to be raised with or after toilet cover 6, and toilet cover 6 has to be lowered with or after toilet seat 7.

The operation of the first embodiment of the toilet seat and cover operating device of this invention will now be described as follows.

When the toilet is not in use, toilet seat 7 and cover 6 are laid on the top of the toilet bowl and floats 513, 523 are held submerged in the water in the flushing tank by holding levers 512, 522. To use the toilet, release lever 51 is pushed manually. As soon as release lever 51 is pushed down, holding lever 512 is pulled by chain or cord 51A to rotate counter clockwise and thus float 513 is released and allowed to buoy up as latch 11 is brought out of engagement with tongue 14A of float 513. The ascending movement of float 513 is then transmitted by shaft 515, lever 514 and connecting road 517 and consequently arm 21A is pulled to rotate rod 8 on which toilet cover 6 is fixedly mounted, thus raising upright toilet cover 6. Counter weight 22A, or spring 23, acts to minimize the force needed for raising cover 6 and therefore the size of float 513 can be minimized.

The toilet cover can be lowered from the upright position when flushing the toilet after use. To do so, release lever 53 is pushed. Then flushing valve 4 is pulled open and the water in the flushing tank is drained and float 513 descends. As soon as float 513 descends shaft 514 is caused to rotate so as to push toilet cover 6 back to its previous, horizontal position, until it lies on top of toilet seat 7. When float 513 finally reaches holding lever 512, it is latched in place by latch 11 of the holding lever 512. Float 513 is thus kept from buoying up after the flushing tank is refilled with water.

Toilet seat 7 can be raised upright by pushing release lever 52. The movement of release lever 52 is then transmitted by chain or cord 52A causing holding lever 522 to rotate so as to disengage tongue 14B of float 523 from latch 11, thus allowing float 523 to buoy up. As soon as float 523 ascends. shaft 525 is rotated to pull connecting rod 527 upwards, and as a result toilet seat 7 is raised upright.

Since holding lever 512 is coupled with holding lever 522 by a pair of coupling 13 in such a manner that when holding lever 525 is pulled to rotate counter clockwise holding lever 515 is cause to rotate therewith, therefore when release lever 52 is pushed to release float 523 from being held, float 513 is also simultaneously released. This arrangement assure the upward movement of toilet seat 7 regardless of whether toilet cover 6 has not already been raised.

Toilet seat 7 and toilet cover 6 can be lowered from the upright position by pushing down flushing lever 53 with which flushing valve 4 is opened to drain the water in the flushing tank, and floats 513, 523 simultaneously descend to lower toilet seat 7 toilet cover 6.

Figure 8:
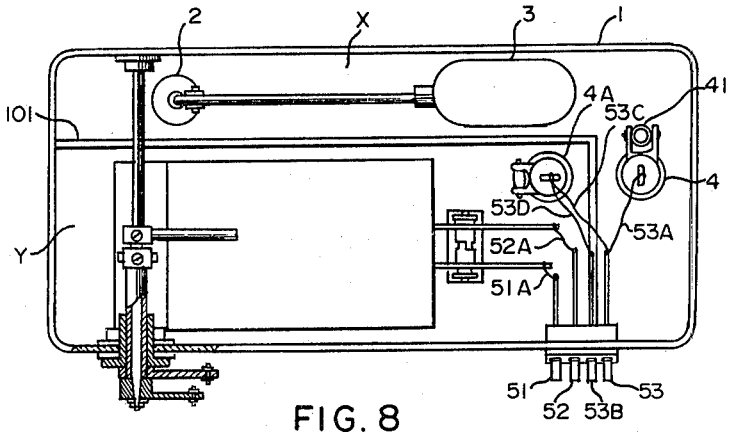
FIG. 8 is a top view of a flushing tank having a second embodiment of the toilet seat and cover operating device of this invention, with the tank cover removed, and partially in section.
Figure 9:
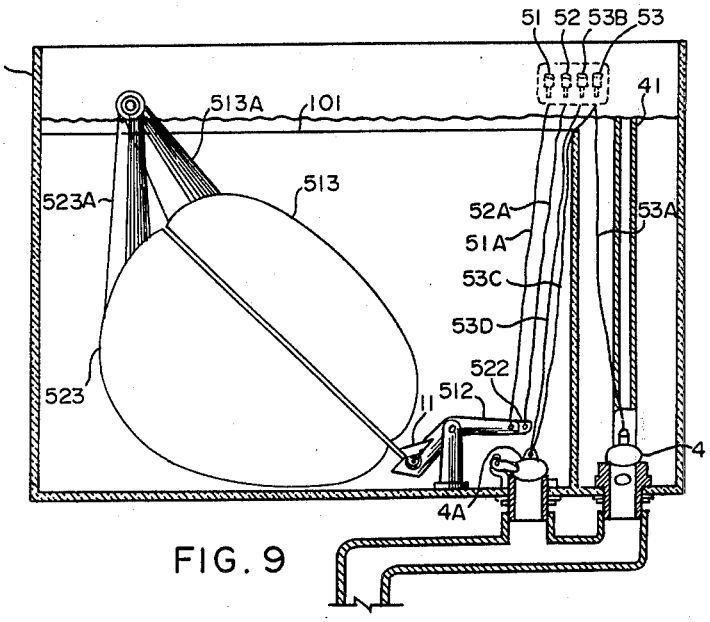
FIG. 9 is a vertical, longitudinal, cross-sectional view of the flushing tank shown in FIG. 8.

FIGS. 8 and 9 show a second embodiment of this invention. In this embodiment flushing tank casing 1 is separated into compartment X and compartment Y by a partition 101 having a height slightly lower than that of overflow pipe 41. In compartment X are accommodated water inlet valve 2, inlet valve control float 3, flushing valve 4 and over flow pipe 41. In compartment Y are accommodated floats 513, 523 and holding levers 512, 522. Water is supplied from inlet valve 2 and allowed to flow over partition 101 from compartment X in to compartment Y. An additional flushing valve 4A is provided in compartment Y, said additional flushing valve 4A being operatively connected to an additional flushing lever 53B and flushing lever 53 with chains or cords 53D and 53C respectively. In this arrangement, water in both compartments X and Y is drained when flushing lever 53 is pushed. When the additional flushing lever 53B is pushed only water in compartment Y is drained and thus less water is used for flushing the toilet. This provides an option for saving water in flushing a toilet as one may sometimes wish.

Figure 10:
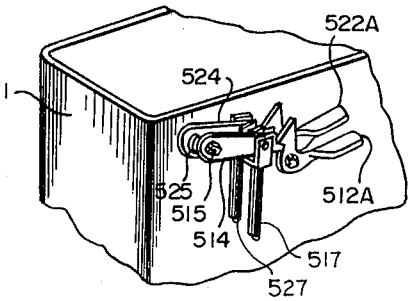
FIG. 10 is a perspective view of the latch levers that replace the holding levers.

The holding levers 512, 522 may be replaced by other suitable means such as the device shown in FIG. 10. In this arrangement, latch levers 512A, 522A are pivotally mounted in a suitable place on casing 1 for latching levers 514, 524 when the floats are in the lower-most position. Latch levers 512A, 522A are coupled to each other by a pair of couplings similar to those (13) used for coupling the holding levers 512, and 522. Latch levers 512A, 522A are each provided with a spring (not shown) so as to urge the latch levers 512A, 522A counterclockwise. When latch levers 512A, 522A are pushed to rotate clockwise, levers 514, 524 are released and thus floats 513, 523 are allowed to buoy up. This arrangement also eliminates the release levers 51 and 52.

It is to be noted that latch levers 512A, 522A are capable of rotating clockwise to release levers 514, 524 when there is a force acting on latch levers 512A, 522A which is greater than that normally generated by the buoyancy of the floats 513, 523.

The installion of floats 513, 523 can be varied in many ways. For illustrative purpose, FIGS. 11 through 14 show four different ways of installing floats 513, 523 in a flushing tank.

Figure 11:
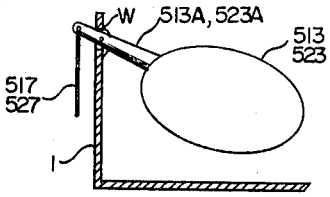
FIGS. 11 through 14 are schematic drawings showing various different ways of the arrangement of the floats and the connecting mechanism.

FIG. 11 shows a first modified arrangement of floats 513, 523, wherein the extension rods 513A, 523A extend through an opening W formed in an upper part of the wall of casing 1, and are pivotally mounted at said opening W. The ends of extension rods 513A, 523A extending outwardly are operatively connected to connecting rods 517, 527.

Figure 12:
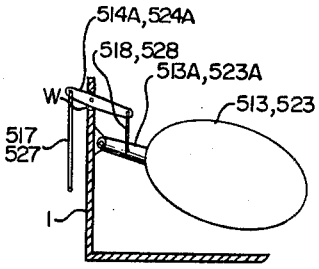

FIG. 12 shows a second modified arrangement of floats 513, 523 wherein the extension rods 513A are pivotally mounted onto a side wall of casing 1, and pivotally connected to levers 514A, 524A which are pivotally mounted onto an upper part of the side wall of casing 1 levers 514A and 524A, having one end operatively connected to said auxiliary connecting rods, and the other end operatively connected to connecting rods 517, 527.

Figure 13:
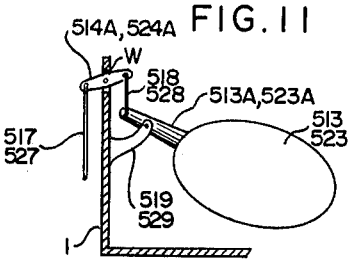

FIG. 13 shows a third modified arrangement of floats 513, 523, wherein the extension rods 513A, 523A are pivotally mounted onto a side wall of casing 1 with elongated supports 519, 529, said extension rods 513A, 523A extending beyond the pivotal mounting point and operatively connected to levers 514A, 524A with auxiliary connecting rods 518, 528, said levers 514A and 524A being pivotally mounted onto an upper part of the side wall of casing 1 and operatively connected to connecting rods 517, 527.

Figure 14:
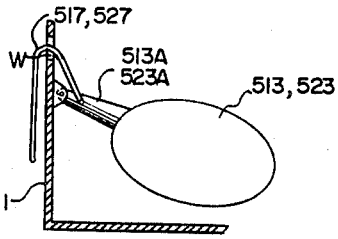

FIG. 14 shows a fourth modified arrangement of floats 513, 523 wherein the extension rods 513A, 523A are pivotally mounted onto a side wall of casing 1, and operatively connected to connecting rods 517, 527, said connecting rods 517, 527 having upper portions so formed to clear the upper part of the side wall of casing 1.

In the arrangements shown in FIGS. 11 through 14 the connecting rods 517, 527 are so connected to the toilet seat and cover that the toilet seat cover are moved up and down in association with up and down movements of floats 513, 523. More specifically, the lower ends of the connecting rods 517, 527 are operatively connected to the opposite ends of the arms 21A, 21B shown in FIG. 3 so that the ascending movement of floats 513, 523 is transmitted to move the toilet seat 7 and cover 6 upright.

Figure 15:
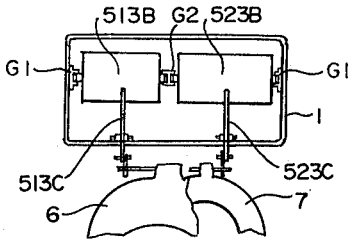
FIG. 15 is a schematic, fragmental, top view of a third embodiment.

FIG. 15 shows a third embodiment of this invention. In this embodiment floats 513B, 523B are each placed in the casing 1 with proper guide means G1, G2. In this arrangement the floats 513B, 523B move up and down vertically instead of pivoting around a pivotal mounting point. The movements of floats 513B, 523B are transmitted by extension rods 513C, 523C operatively connected to the cover 6 and seat 7 respectively and separately.

Figure 16:
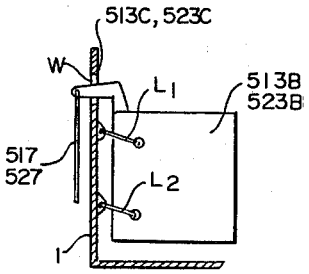
FIG. 16 is a schematic, fragmental, traverse cross-sectional view of a fourth embodiment.

FIG. 16 shows a fourth embodiment of this invention. In this embodiment floats 513B, 523B are each provided with a pair of parallel links L1, L2 pivotally connecting floats 513B, 523B with casing 1. In this arrangement the floats having relatively large dimension in vertical direction can be employed.

Figure 17:
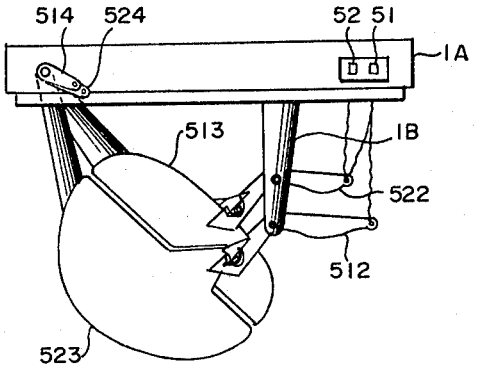
FIG. 17 is a schematic side view of a fifth embodiment of this invention.

FIG. 17 shows a fifth embodiment of this invention. In this embodiment floats 513, 523, levers 514, 524, holding levers 512, 522 and releasing levers 51, 52 are mounted on a separately prepared frame which can be placed on top of a conventional flushing tank. In the drawing 1A is the frame, and 1B is a bracket for pivotally supporting holding levers 512, 522. With this arrangement, the device of this invention can be prepared as a separate unit and installed on a conventional flushing tank without the need of drilling new holes or modifying the existing flushing tank. The cover normally provided with a conventional flushing tank can then be put on the top of the frame 1A. The conventional flushing lever originally provided with the flushing tank (not shown) can be preserved and lever 53 may not be needed.

Figure 18:
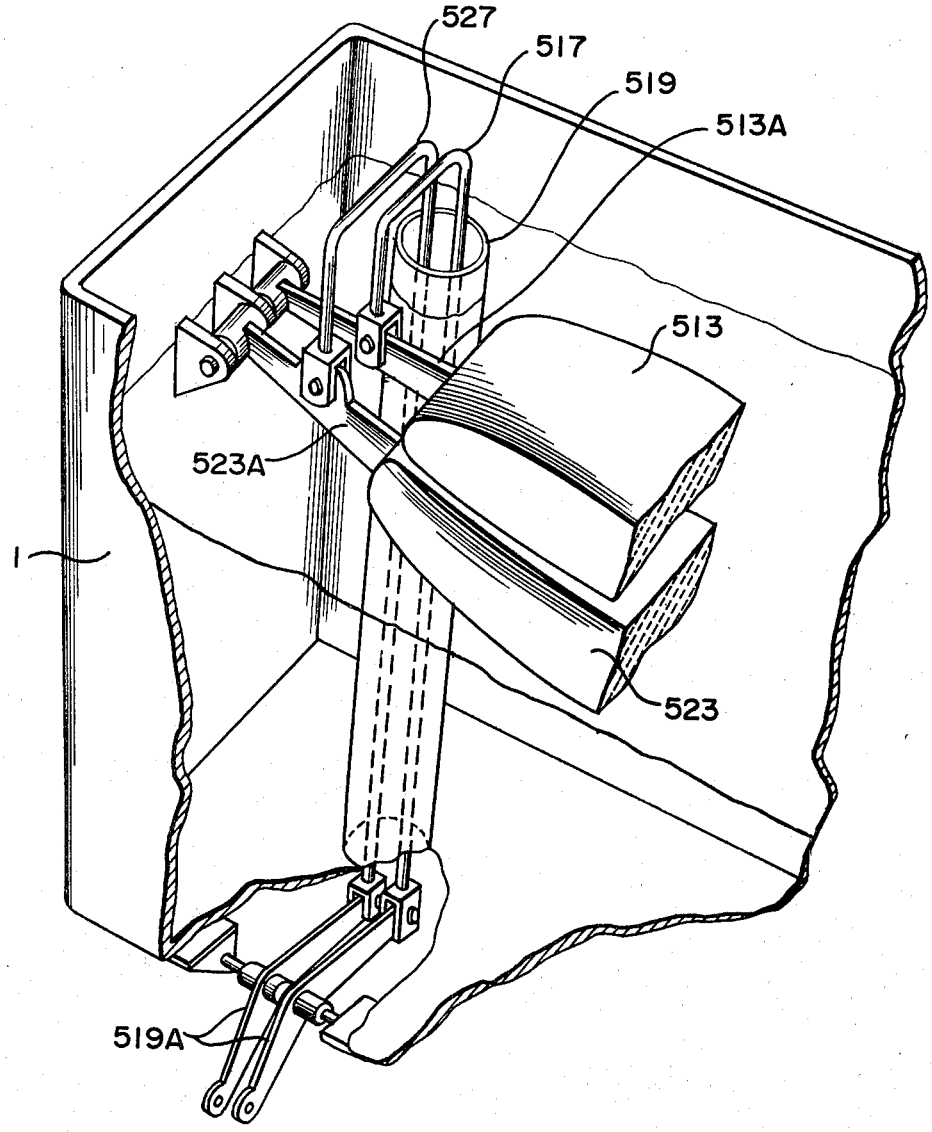
FIG. 18 is a fragmental, perspective view of an embodiment of this invention, showing an alternative arrangement of the connecting rods.

FIG. 18 shows an alternative arrangement of the connecting rods 517, 527 employed in various embodiments of this invention. As shown in FIG. 18, the connecting rods 517, 527 shown in FIGS. 12, 13 and 14 may be provided in a tubular post 519 mounted in or integrally formed with the bottom of flushing tank 1, the tubular post 519 having a height higher than overflow tube 41 (shown in FIGS. 1 and 2) and an interior communicating with the outside of the bottom of flushing tank 1. Connecting rods 517, 527 are inserted in tubular post 519, with their upper ends operatively connected to extension rods 513A, 523A, respectively and their lower ends operatively connected to auxiliary bell cranks 519A to be further operatively connected to toilet seat and cover, not shown, It is to be understood that tubular post 519 can also be employed in the embodiments shown in FIGS. 3, 10, 11 and 15 by forming the connecting rods into a proper shape or providing the connecting rods with a proper bell crank or linkage mechanism.

The connecting rods 517, 527 can be replaced by other suitable connecting means such as chains or flexible cords. Chains or flexible cords provide the advantage that the toilet seat and cover can be raised by hand without interferring with the device of this invention.

It is to be understood that the device of this invention can be modified in many ways without departing from the scope of this invention as defined in the appended claims.

I claim:

1. A toilet seat/cover operating device, comprising:
(a) a float member capable of floating on water and installed in a flushing tank for a toilet bowl, said float member being capable of moving up and down in the flushing tank;
(b) connecting means for operatively connecting said float member to the seat/cover of the toilet bowl so as to raise and lower the toilet seat/cover in association with the upward and downward movements of said float member;
(c) holding means for latching said float member when said float member moves down to a lowermost position and holding it submerged when said flushing tank is filled with water; and
(d) releasing means for causing said holding means to release said float member from being latched to enable said float member to buoy up through the water in the flushing tank.

2. A toilet seat/cover operating device as in claim 1, wherein said connecting means comprises a connecting member having an upper and lower end, said upper end being operatively connected to said float member, said lower end operatively connected to the seat/cover with an arm fixedly connected to the seat/cover with a rod or sleeve means.

3. A toilet seat/cover operating device as in claim 2, wherein said arm is provided with a counterweight.

4. A toilet seat/cover operating device as in claim 2, wherein said rod or sleeve means is provided with a resilient urging means to partially offset the weight of the toilet seat/cover.

5. A toilet seat/cover operating device as recited in claim 2, 3, or 4, wherein said flushing tank is further provided with an overflow tube, a tubular post having a height higher than said overflow tube, said tubular post having a lower end fixedly connected to the bottom of said flushing tank and an interior communicating with the outer side of the bottom of said flushing tank, and said connecting member is disposed in said tubular post.

6. A toilet seat/cover operating device as in claim 1, wherein said float member and holding means are mounted onto the flushing tank.

7. A toilet seat/cover operating device as in claim 1, wherein said float member and holding means are mounted on a frame capable of being placed on top of the casing of the flushing tank.

8. A toilet seat/cover operating device as in claim 7, wherein said float member is provided with an extension rod which is pivotally mounted onto said frame.

9. A toilet seat/cover operating device as in claim 7, wherein said float member is provided with two parallel links pivotally connecting said float member with said frame.

10. A toilet seat/cover operating device as in claim 1, 6 or 7 wherein said float member is accommodated in a compartment separated by a partition in the casing of the flushing tank, said partition having a height lower than the height of said overflow pipe, said compartment having a flushing valve.

11. A toilet seat/cover operating device as in claim 1, 6 or 7 wherein said float member is guided with guide means adapted to guide said float member in moving up and down.

12. A toilet seat/cover operating device as in claim 1, wherein said float member is provided with an extension rod which is pivotally mounted onto said flushing tank.

13. A toilet seat/cover operating device as in claim 1, wherein said float member is provided with two parallel links pivotally connecting said float member with said casing.

* * * * *

UNITED STATES PATENT AND TRADEMARK OFFICE

CERTIFICATE OF CORRECTION

PATENT NO. : 4,433,442

DATED : February 28, 1984

INVENTOR(S) : SHU L. LIOU

It is certified that error appears in the above—identified patent and that said Letters Patent is hereby corrected as shown below:

Column 7, line 23, after"end" insert -- being --.

line 25, delete "or sleeve means".

line 29, delete "or sleeve means".

Signed and Sealed this

*Twenty-second* Day of *May 1984*

[SEAL]

*Attest:*

GERALD J. MOSSINGHOFF

*Attesting Officer*

*Commissioner of Patents and Trademarks*